United States Patent [19]

Westip

[11] 4,331,135

[45] May 25, 1982

[54] PERMANENTLY ELASTIC NETWORK BANDAGE

[75] Inventor: Wilhelm Westip, Wuppertal, Fed. Rep. of Germany

[73] Assignee: Lohmann GmbH & Co. KG, Neuwied, Fed. Rep. of Germany

[21] Appl. No.: 200,487

[22] Filed: Oct. 24, 1980

[30] Foreign Application Priority Data

Oct. 26, 1979 [DE] Fed. Rep. of Germany ..... 2943401

[51] Int. Cl.[3] ..... A61L 15/00; D04B 23/08

[52] U.S. Cl. ..... 128/156; 66/193

[58] Field of Search ..... 128/156; 66/193, 172 E, 66/178 A, 190, 198–199

[56] References Cited

U.S. PATENT DOCUMENTS

| | | | |
|---|---|---|---|
| 3,448,595 | 6/1969 | Baltzer et al. | 66/193 |
| 3,570,482 | 3/1971 | Emoto et al. | 128/156 |
| 3,740,974 | 6/1973 | Bourgeois | 66/193 |
| 4,052,866 | 10/1977 | Saunders | 66/193 |
| 4,215,684 | 8/1980 | Westip | 66/193 |

*Primary Examiner*—C. Fred Rosenbaum

*Attorney, Agent, or Firm*—Becker & Becker, Inc.

[57] ABSTRACT

A permanent elastic net-shaped bandage including a fabric with elastic threads as warps and with non-elastic threads transverse thereto forming wefts. More specifically, the warps are designed as fringe warps of non-elastic threads and are independent of each other while being backed by an elastic synthetic thread. The non-elastic wefts comprise upper and lower wefts which always rest on the same spot of the fringe warp, which is engaged by the adjacent upper and lower wefts, and between the skips from fringe warp to fringe warp are in an arc-shaped manner lying a plurality of times on the fringe warp.

2 Claims, 2 Drawing Figures

PERMANENTLY ELASTIC NETWORK BANDAGE

The present invention relates to a permanently elastic network or reticular bandage of the type described in U.S. Pat. No. 4,215,684 and owned by the assignee of the present application. In particular, the bandage comprises a fabric having, as warps, fringe warps of non-elastic threads independent of one another which are underlaid with an elastic plastics thread, and having non-elastic threads extending transversely to this latter as weft. The non-elastic weft threads are always applied against the same point of the fringe warp, at which the adjacent weft also engages, with the weft threads, between the jumps from fringe warp to fringe warp, being repeatedly laid on this latter in curved form. The fringe warp and the elastic plastics threads extend parallel to one another, and the weft threads extend at right angles thereto and jump to a more remote fringe warp.

In this way there is produced a particularly light and coarse-meshed network bandage, in which simultaneously the danger of shrinkage in width is substantially eliminated.

It is an object of the present invention, in the case of the known permanently elastic network bandage, to increase the transverse or width stability, without reducing the large free cross-section between the meshes.

Figure 2:
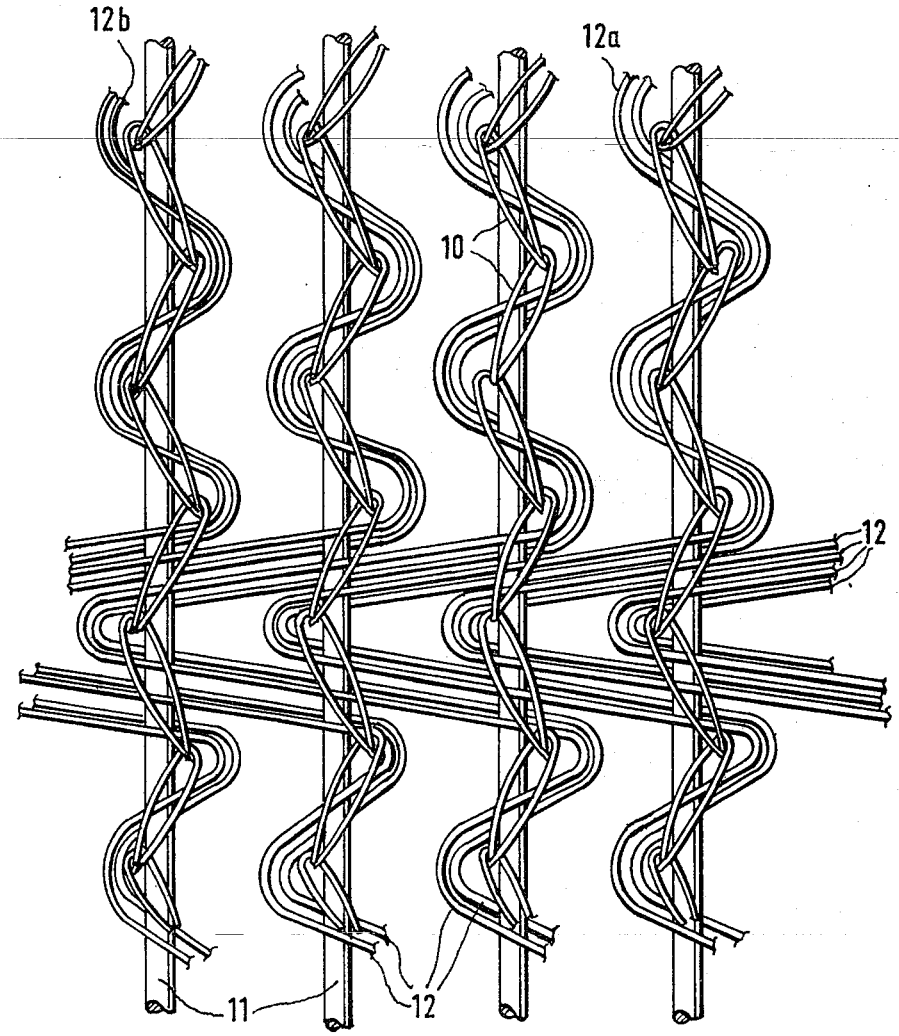
Figure 1:
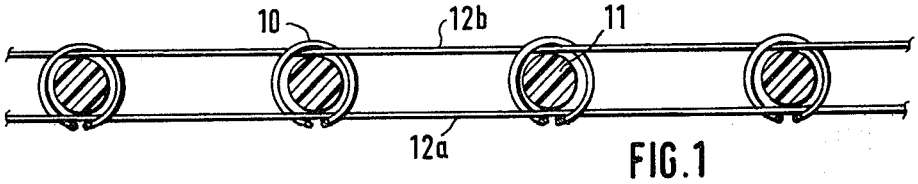

This object, and other objects and advantages of the present invention, will appear more clearly from the following specification in connection with the accompanying drawing, in which:

FIG. 1 shows a cross section through one embodiment of the inventive bandage; and FIG. 2 shows the mesh pattern of the bandage in a top view.

The bandage of the present invention is characterized primarily in that the weft threads are arranged as upper weft and lower weft, and both wefts are interlaced by the fringe warps.

Advantageously, the two wefts are congruent.

A permanently elastic network bandage is thereby provided, in which the box shape of the apertures between the meshes is maintained, yet the transverse stability is increased. The additional weft increases the width stability of the network bandage. The network bandage is equilateral or double-faced, since the upper weft and lower weft extend congruently. The overlapping wefts join together in each case three fringe warps and thereby stabilize the network bandage.

Referring now to the drawing in detail, the independent fringe warps or fringe rods of non-elastic threads 10 of polyamide form the warps and are backed with stretched polyurethane threads 11. Between these fringe warps 10, which extend parallel to one another and in the direction of machine travel, and the polyurethane threads 11, there are arranged wefts of non-elastic threads 12, for example cotton threads, which uniformly in each case join together three fringe warps 10.

The weft threads 12 are arranged as upper weft **12*a* and lower weft 12*b*. Both wefts 12*a* and 12*b* are congruently tied-in or interlaced by the fringe warps 10, although in FIG. 2 they are shown lying side by side only for illustration purposes. When viewing the mesh pattern of the finished network bandage from one side or the other, only the upper weft or the lower weft is visible, in which case a symmetrical mesh pattern is provided which has relatively large apertures between the fringe warps 10 and the weft threads 12**. Nevertheless, the network bandage has increased width stability.

The present invention is, of course, in no way limited to the specific disclosure of the specification and drawing, but also encompasses any modifications within the scope of the appended claims.

What we claim is:

1. A permanent elastic net-shaped bandage for medical purposes, comprising a fabric with elastic threads as warps and with non-elastic threads extending transverse thereto and forming wefts, which includes in combination therewith: fringe warps independent of each other and formed by non-elastic threads, and backings of elastic synthetic threads backing said fringe warps, said fringe warps and said elastic synthetic threads being arranged substantially parallel to each other, said non-elastic weft threads and the respective adjacent wefts being arranged as upper wefts and lower wefts engaging the same area of the pertaining fringe warp and being interlaced by said fringe warps while said non-elastic upper and lower weft threads between skips from fringe warp to fringe warp are lying on the respective fringe warp in the form of a plurality of arcs, and said pertaining upper and lower weft threads extend at a substantially right angle to said fringe warps and said elastic synthetic threads.

2. A bandage in combination according to claim 1, in which said upper and lower wefts are congruent.

* * * * *